United States Patent [19]

Graul

[11] Patent Number: 4,653,178

[45] Date of Patent: Mar. 31, 1987

[54] METHOD FOR THE MANUFACTURE OF A LAYER WINDING

[75] Inventor: Otto Graul, Bamberg, Fed. Rep. of Germany

[73] Assignee: MWB Messwandler-Bau AG, Fed. Rep. of Germany

[21] Appl. No.: 760,891

[22] Filed: Jul. 31, 1985

[30] Foreign Application Priority Data

Aug. 4, 1984 [DE] Fed. Rep. of Germany ..... 3428893

[51] Int. Cl.[4] ..... H01F 41/06

[52] U.S. Cl. ..... 29/605; 336/206

[58] Field of Search ..... 336/205, 206, 223; 29/605

[56] References Cited

U.S. PATENT DOCUMENTS 3,633,140 1/1972 Lake et al. ..... 336/206 X 3,783,427 1/1974 Zetterlund ..... 336/206

3,928,832 9/1974 Forsberg et al. ..... 336/206 X

*Primary Examiner*—Carl E. Hall

*Attorney, Agent, or Firm*—Barnes & Thornburg

[57] ABSTRACT

A method for the manufacture of a layer winding for transformers, measuring transformers, choke coils or the like is to be so improved that the insulation of such a layer winding exhibits practically no free spaces in the insulating tape edge areas. This is assured in that when reaching the outer end face (12) of a layer winding edge (4), the insulating tape (2) is continued to be wound and the band portion (13) of the insulating tape (2) which projects beyond the edge face (12) is continuously cut off. The remaining residual portion of the insulating tape (15) is then continued to be wound with zero pitch for such length of time until the free spaces which otherwise occur at the layer winding edge (4') are filled out.

22 Claims, 3 Drawing Figures

METHOD FOR THE MANUFACTURE OF A LAYER WINDING

The present invention relates to a method for the manufacture of a layer winding with a plurality of mutually changing layers of insulating tapes and conductors and to a layer winding made according to this method.

A method for the manufacture of such a layer winding is disclosed in the DE-AS 21 57 452. In this method, all insulating layers and also the edge areas for the lateral determination of the winding conductor are wound from a single continuous insulating tape. This offers the advantage that the winding arrangement does not have to be stopped for the manufacture of the insulating tape layers and of the insulating tape edge areas. However, it entails the disadvantage that the insulating tape edge areas have free spaces which considerably reduce the mechanical strength of the insulating tape edge areas.

The problem is to be solved with the present invention is to so improve this prior art method and the layer winding to be made therewith, that the insulation exhibits few possible free spaces or no free spaces. This is also true in the insulating tape edge areas.

The underlying problems are solved, according to the present invention, in that upon reaching the outer end face of a layer winding edge, the insulating tape is continued to be wound and the tape portion of the insulating tape which projects beyond the end face, is continuously cut off. The remaining residual tape is then continued to be wound for such length of time without feed until the free spaces which otherwise would occur at the layer winding edge are filled out. In the layer winding according to the present invention, the free spaces at the edge of the free ends of the winding layers, which occur during the winding of the insulating layers with predetermined pitch, are compensated for by coaxial windings of the residual tape remaining within the outer edge zones of the edges.

The free spaces in the edge areas of the winding layers which heretofore were troublesome for mechanical and also electrical reasons are practically completely eliminated by the present invention. One obtains therewith mechanically very stable edge areas and therewith also a high mechanical strength of the entire layer winding. Since the edge areas no longer have any free spaces, the electrical strength is better than with layer windings made according to the prior art method. Furthermore, in contrast to the prior art method, edge strips of different width can be used and therewith differently wide edge areas of the windings can be manufactured. By the use of a harder insulating material for the edge strip, an additional reinforcement or strengthening of the layer winding can be achieved.

These and other objects, features and advantages of the present invention will become more apparent from the following description when taken in connection with the accompanying drawing which shows, for purposes of illustration only, one embodiment in accordance with the present invention, and wherein.

Figure 1:
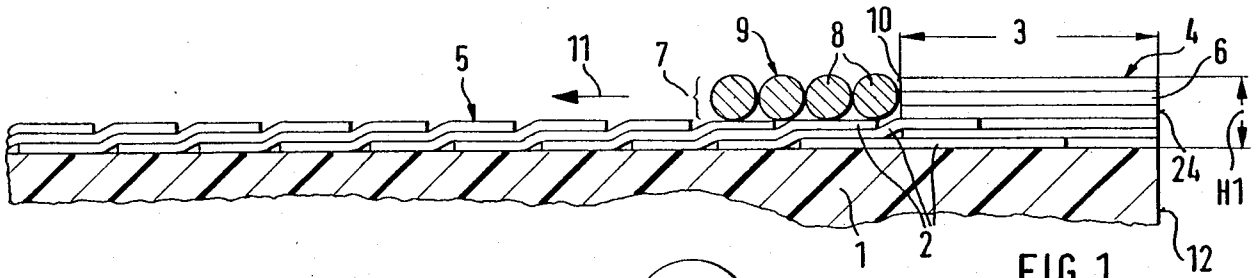
FIG. 1 is a somewhat schematical partial cross-sectional view of the end of one side of a winding layer in accordance with the present invention during the start of the winding operation.

Referring now to the drawing wherein like reference numerals are used throughout the various views to designate like parts, reference numeral 1 designates a coil body, for example, of plastic material, Pertinax, Pressspan or the like. In FIG. 1, an insulating tape 2, for example, of paper, or of a plastic foil, is applied approximately in the middle third of an edge area 3 of the right first edge 4 and is wound with a predetermined starting pitch. For example, the pitch is selected in the FIG. 1 example so that with an overlap width of ⅓, a triple layer is obtained, as the first insulating layer generally designated by reference numeral 5. After the winding start of the insulating tape 2, an insulating edge strip 6 is inserted, or applied, and/or glued-on, in the edge area 3 and is wound into an edge generally designated by reference numeral 4. The height H 1 of this edge strip 6 is at least approximately equal to the combined height of the insulating layer 5 and 7 the height of the winding layer 9 of a winding wire 8. While edge strip is being applied, the insulating tape 2 is continued to be wound in the same winding direction as the winding wire 8.

The width of the strip edge 6 is smaller than the width of the insulating tape 2. The cross section of the winding wire 8 may be round, square or rectangular. However, foil conductors may also be used. The winding wire 8 itself is insulated in a known manner, for example, surrounded with lacquer and/or provided with a covering or the like.

After the formation of the first edge 4 in the indicated height H1, the winding wire 8 is placed against the inside 10 of the first edge 4. Subsequently, the insulating tape 2 and the winding wire 8 are wound in the direction of the arrow 11 with the insulating tape 2 leading the winding of the wire.

When the insulating tape 2 reaches the left coil body edge, respectively, edge area 3' (see FIG. 2), the insulating tape 2 is continued to be wound with the same or possibly also with a changed, preferably reduced pitch, and the tape portion 13 projecting beyond the left end surface 12 of the coil body 1 is continuously cut off by a schematically indicated cutting mechanism 14 (see tape portion 13 in dash line in FIG. 3), until the width of the insulating tape 2 within this edge area 3' amounts to approximately one-third to one-fourth of the original tape width. Upon reaching this tape width, or shortly prior or shortly afterwards, especially with a width of the tape portion 13 of 15% to 30% of the original tape width, an edge strip 6' is inserted, or applied and/or glued on and subsequently the edge 4' is wound. The residual tape 15 (see FIG. 3) of the insulating tape 2 is continued to be wound with the constant width of about 33% to about 25% of the original tape width, especially together with the edge strip 6'. The rim wedge which is formed at the edge during the customary winding with a pitch during the to-and-fro winding operation and which has the free spaces, is avoided, and all otherwise occurring free spaces 16 are filled out. For example, the last left tape third is no longer wound in FIG. 2 in the first insulating layer 5 so that this insulating layer 5 is only two-layered thereat. The filling out of the free space 16 which thereby occurs thereat, is achieved in that the next layer of the edge strip 6' is wound together with the residual tape 15 of constant width. The free space 16 which is disposed therebelow is completely filled out thereby. The length, respectively, number of the windings with the residual tape 15 which is then continued to be wound without pitch, is so selected and dimensioned that the surface of the second edge 4' extends again at least nearly parallel to the winding axis. The residual tape 15 is then cut off and then is glued-on or otherwise attached with the end 17 at its last layer or possibly on the edge strip 6'. For example, the gluing-on of the insulating tapes 2 or of the edge strips 6, 6' may take place in each case by means of an adhesive tape, adhesive on one side especially of a self-gluing insulating adhesive tape.

The edge 4' is wound together with the edge strip 6' up to the height H 2 of two winding layers which, in this case, corresponds approximately to the height of the first insulating layer 5 and twice the diameter of the winding wire 8. Subsequently, the edge strip 6' is cut off and its end 18 is glued-on (see FIG. 3).

Still further edge strips of a material with different hardness, density, electrical or mechanical strength, or with good suction capability in case of layer windings to be subsequently impregnated, or the like, can be wound into the edges 4, respectively, 4'. The edge strips 6, 6' may eventually become thicker than the thickness of the insulating tape 2.

Figure 2:
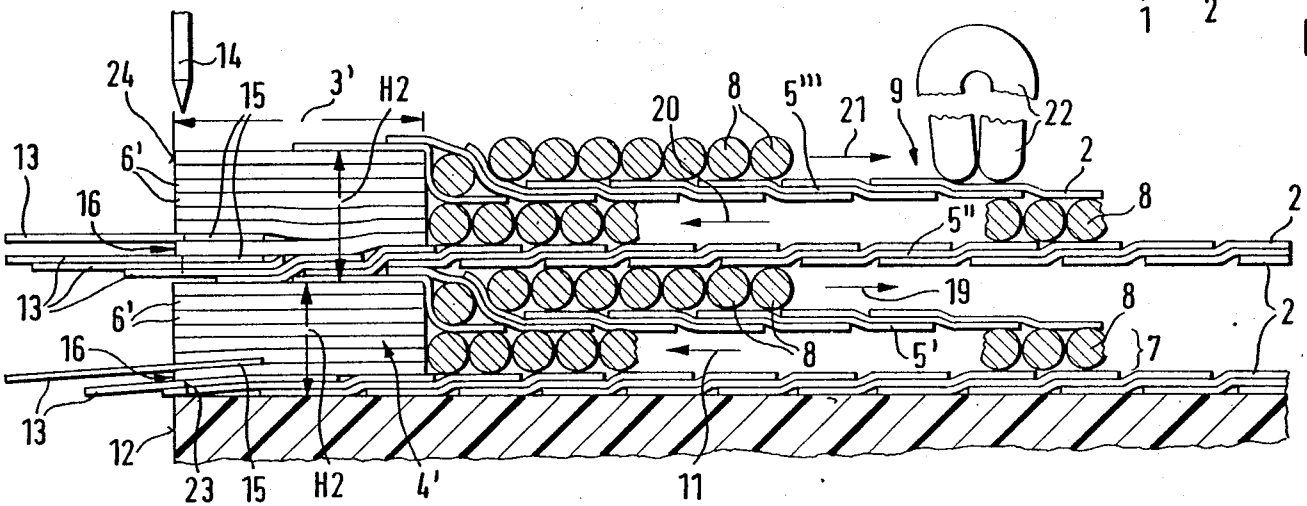
FIG. 2 is a somewhat schematic partial cross-sectional view of the other side of the layer winding during the winding of the fourth layer.

After completion of the second edge 4', the first winding layer 7 is then wound full with the winding wire 8 until the winding wire 8 abuts at the edge 4' on the inside thereof. Thereupon, the insulating tape 2 is immediately with predetermined pitch applied in the middle third of the edge 4' and both the insulating tape 2 as also the winding wire 8 are now continued to be wound with reversed pitch and reversed feed direction in the direction of the arrow 19. The insulating tape 2 thereby overtakes the winding wire 8 by reason of the larger pitch thereof. The insulating tape 2 then arrives again first at the right side and the edge structure then takes place at the edge 4 with double winding height H 2 as described by reference to the edge 4'. A similar edge structure will result thereby, as is shown in FIG. 2 between the second and third winding layer. The winding operation is continued corresponding to the direction of arrow 20, 21, etc. until the calculated coil size of the layer winding is reached.

If a layer winding is to be manufactured with taps or lead-outs, then the insulating layer 5, 5', 5'', etc. is made as uniform as possible at a tap 22, for example, by connection of the winding wire 8, or by the application and connection of an electrical connector or the like, corresponding to the permissive layer voltage. The pitch of the insulating tape 2 is increased within the area of the tap 22, especially on both sides thereof to maintain a proper thickness. However, it may also be of advantage to improve the insulation thereat. In that case, the pitch of the insulating tape 2 is decreased within this area. Advantageously, with increasing layer voltage, the pitch of the insulating tape 2 is reduced in a known manner stepwise or continuously. Especially also the pitch of the insulating tape 2 can be made smaller in middle winding layers than in further outwardly located winding layers because by reason of the greater heating-up or the like, higher electric loads may occur thereat.

It may be advantageous for electrical or mechanical reasons to provide the cutting edge 23 of the residual tape 15, or of the entire inclined end section further inwardly than corresponds to the outer edge 24 of the edge strip 6, respectively, 6'. In that case, the free ends 24 of the edge strips 6, 6' project over the cutting edges 23 of the residual tape 15 by about 1 mm or slightly more as is shown in plan view on the developed insulation layer in FIG. 3.

Figure 3:
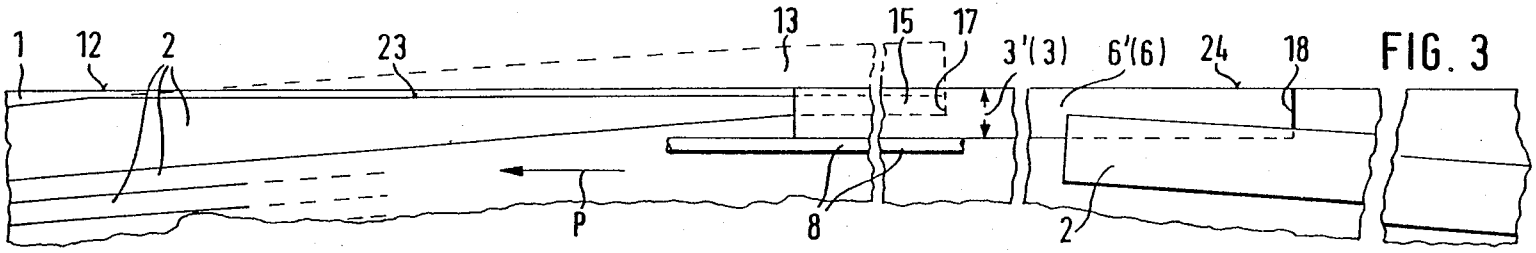
FIG. 3 is a somewhat schematic plan view of the development of an insulating layer in the left edge area of the layer winding.

For better understanding of the method, the direction of rotation of the coil body 1 is indicated in FIG. 3 by arrow P.

In order to fill the free spaces in the edge areas of the winding layers particularly effectively with insulating material, it is favorable if the insulating tape 2, after reaching the maximum edge projection, is returned in the opposite direction and if the insulating tape 2, respectively, the remaining residual tape 15 is then continued to be wound without feed for such length of time until the edge 4' is formed to the double height H 2 of a winding layer.

A particularly good mechanical connection between the insulating tapes 2 and the edge strips 6, 6' results if at the instant or after the beginning of the insulating tape cut, an edge strip 6' is applied or inserted and is secured on the insulating tape 2. It is also favorable if the edge strip 6' is wound at least partially together with the insulating tape 2, respectively, with the residual tape 15 up to the double height H 2 of a winding layer.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A method for the manufacture of a layer winding, for transformers, measuring transformers, choke coils and coils for other inductive apparatus having a large number of insulating layers and winding layers consisting of insulating tapes and conductors, respectively, which alternate with one another, whereby the respective insulating layer is wound at the same time and in the same direction with the winding layer wound on the insulating layer and the insulating tape has a larger width than the width or diameter of a conductor, and in which the insulating tape is wound at least within a larger section of an insulating layer with a larger pitch than the conductor and an edge of insulating material of twice the height of a winding layer is established at the edges of the winding layers, comprising the steps of continuing to wind the insulating tape upon reaching the outer end face of a layer winding edge, continuously cutting off the tape portion of the insulating tape projecting over the end face, and continuing to wind the remaining insulating tape with a zero pitch for such length of time until the free spaces otherwise occurring at the layer winding edge are completely filled out.

2. A method according to claim 1, wherein the edge up to twice the height of a winding layer is formed at the same time by the remaining insulating tape.

3. A method according to claim 2, further comprising the step of returning the insulating tape in the opposite direction after reaching the maximum edge projection and then continuing to wind the remaining tape with a zero pitch for such length of time until the edge is formed up to twice the height of a winding layer.

4. A method according to claim 3, wherein the projecting tape portion of the insulating tape is cut for such length of time until the remaining residual tape amounts to one-third to one-fourth of the original tape width.

5. A method according to claim 4, further comprising the step of applying at the instant of the beginning or shortly after the beginning of the insulating tape cut, an edge strip and securing the same on the insulating tape, and winding the edge strip at least partially together with the insulating tape, respectively, remaining tape up to twice the height of a winding layer.

6. A method according to claim 5, wherein after completion of the edge, the first winding layer is wound completely with the winding wire and subsequently the insulating tape is applied to the completed edge, whereupon the insulating tape and the winding wire are both continued to be wound together in the opposite direction at least over a part of the winding layer with a reverse pitch.

7. A method according to claim 6, wherein with increasing layer voltage the pitch of the insulating tape is reduced.

8. A method according to claim 7, wherein the reduction of the pitch is stepwise.

9. A method according to claim 7, wherein the reduction of the pitch is continuously.

10. A method according to claim 7, wherein within the area of taps or lead-outs of the conductor, the pitch of the insulating tape is increased on both sides of this layer area along a predetermined winding section.

11. A method according to claim 7, wherein insulating tapes made of a plastic insulating foil, of paper or of Pressspan are used.

12. A method according to claim 7, wherein the edge strips are inserted or applied only after a reduction of the width of the insulating tape by cutting the projecting tape portion up to about 15% to about 30% of the original tape width.

13. A method according to claim 12, wherein further edge strips of substantially the same width but having one of different hardness, density, electrical insulating properties and/or mechanical strength are wound into the edge.

14. A method according to claim 1, further comprising the step of returning the insulating tape in the opposite direction after reaching the maximum edge projection and then continuing to wind the remaining tape with zero pitch for such length of time until the edge is formed up to twice the height of a winding layer.

15. A method according to claim 1, wherein the projecting tape portion of the insulating tape is cut for such length of time until the remaining residual tape amounts to one-third to one-fourth of the original tape width.

16. A method according to claim 1, further comprising the step of applying at the instant of the beginning or shortly after the beginning of the insulating tape cut, an edge strip and securing the same on the insulating tape, and winding the edge strip at least partially together with the insulating tape, respectively, remaining tape up to twice the height of a winding layer.

17. A method according to claim 1, wherein after completion of the edge, the first winding layer is wound completely with the winding wire and subsequently the insulating tape is applied to the completed edge, whereupon the insulating tape and the winding wire are both continued to be wound together in the opposite direction at least over a part of the winding layer with a reverse pitch.

18. A method according to claim 1, wherein with increasing layer voltage the pitch of the insulating tape is reduced.

19. A method according to claim 1, wherein within the area of taps or lead-outs of the conductor, the pitch of the insulating tape is increased on both sides of this layer area along a predetermined winding section.

20. A method according to claim 1, wherein insulating tapes made of a plastic insulating foil, of paper or of Pressspan are used.

21. A method according to claim 16, wherein the edge strips are inserted or applied only after a reduction of the width of the insulating tape by cutting the projecting tape portion up to about 15% to about 30% of the original tape width.

22. A method according to claim 21, wherein further edge strips of substantially the same width but having one of different hardness, density, electrical insulating properties and/or mechanical strength are wound into the edge.

* * * * *